US005396858A

United States Patent [19]

Francis

[11] Patent Number: 5,396,858

[45] Date of Patent: Mar. 14, 1995

[54] ANCHOR

[76] Inventor: Rex W. Francis, Lot 27 Dunstan Road, Avonsleigh, VIC 3782, Australia

[21] Appl. No.: 173,354

[22] Filed: Dec. 23, 1993

[30] Foreign Application Priority Data

Dec. 23, 1992 [AU] Australia ..... PL6547

[51] Int. Cl.[6] ..... B63B 21/32

[52] U.S. Cl. ..... 114/301

[58] Field of Search ..... 114/294, 295, 297–309

[56] References Cited

U.S. PATENT DOCUMENTS 3,022,762 2/1962 Hillcourt ..... 114/306
4,781,142 11/1988 Cheung ..... 114/301
4,798,159 1/1989 Taylor et al. ..... 114/302

*Primary Examiner*—Jesus D. Sotelo
*Attorney, Agent, or Firm*—Thomas R. Vigil

[57] ABSTRACT

The present invention provides:

an anchor comprising a plough portion which is generally V-shaped in plan to taper from a broad portion at one end to a holding entering point at the other end, and which is generally V-shaped in cross-section transverse to the length of the plough portion between the ends, a shank attached to the plough portion and to which an anchor cable, chainrope or rode may be affixed, and tines extending from adjacent the broad portion of the plough portion in a generally forward direction.

7 Claims, 4 Drawing Sheets

ANCHOR

FIELD OF THE INVENTION

This invention relates to an anchor.

BACKGROUND TO THE INVENTION

There is a need to anchor boats, buoys, drilling rigs and other water-borne craft in various holdings such as sand, mud, gravel, rock and coral and an anchor which suits one holding may not suit another holding.

SUMMARY OF THE INVENTION

The present invention provides:

an anchor comprising a plough portion which is generally V-shaped in plan to taper from a broad portion at one end to a holding entering point at the other end, and which is generally V-shaped in cross-section transverse to the length of the plough portion between the ends, a shank attached to the plough portion and to which an anchor cable, chainrope or rode may be affixed, and tines extending from adjacent the broad portion of the plough portion in a generally forward direction.

PREFERRED FEATURES OF THE INVENTION

Preferably there are a pair of such tines on each side of the plough.

Preferably one of each said pair is upwardly directed and the other is downwardly directed.

Preferably the tines are mounted laterally outboard of the plough portion.

Preferably the tines are mounted on arms.

Preferably the arms are pivotally mounted so that the arms may swing from a laterally outwardly extended condition to an inboard position. This last will be useful for storage of the anchor.

Preferably abutment means is provided to maintain the arms in said laterally outwardly extended condition.

Preferably the shank is mounted to the plough portion to pivot from side to side about a generally vertical axis. This will allow some yawing of a boat. Pivoting through 30°–60° i.e. 15°–30° about a central position is preferred.

Preferably the shank is mounted to the plough portion to pivot up and down about a generally horizontal axis.

Preferably means is provided which can restrict pivoting up and down about the generally horizontal axis to be 50° or less, more preferably 40° or less. That means may be releasable to allow pivoting up and down about the generally horizontal axis by 45° or more, preferably 60° or more and most preferably 80° or more.

The amount of pivoting about the horizontal axis may be reduced or enlarged dependant on the use to which the anchor will be put.

Preferably the plough has apertures to release suction in sand or mud during recovery of the anchor.

Similar acting apertures may be located in other regions.

The apertures also aid the anchor in landing upright on the bottom and help the anchor to sink more rapidly in sand in that flow of water through the apertures sets up a turbulence beneath the anchor to aid penetration. Also, when a boat thumps on the anchor a similar effect is shown and a pumping action is created.

Preferably abutments are provided about which the anchor can pivot to assist in release of the tines from rock or coral.

A specific construction of an anchor in accordance with the present invention will now be described by way of example with reference to the accompanying drawings.

INTEGER LIST

Figure 1:
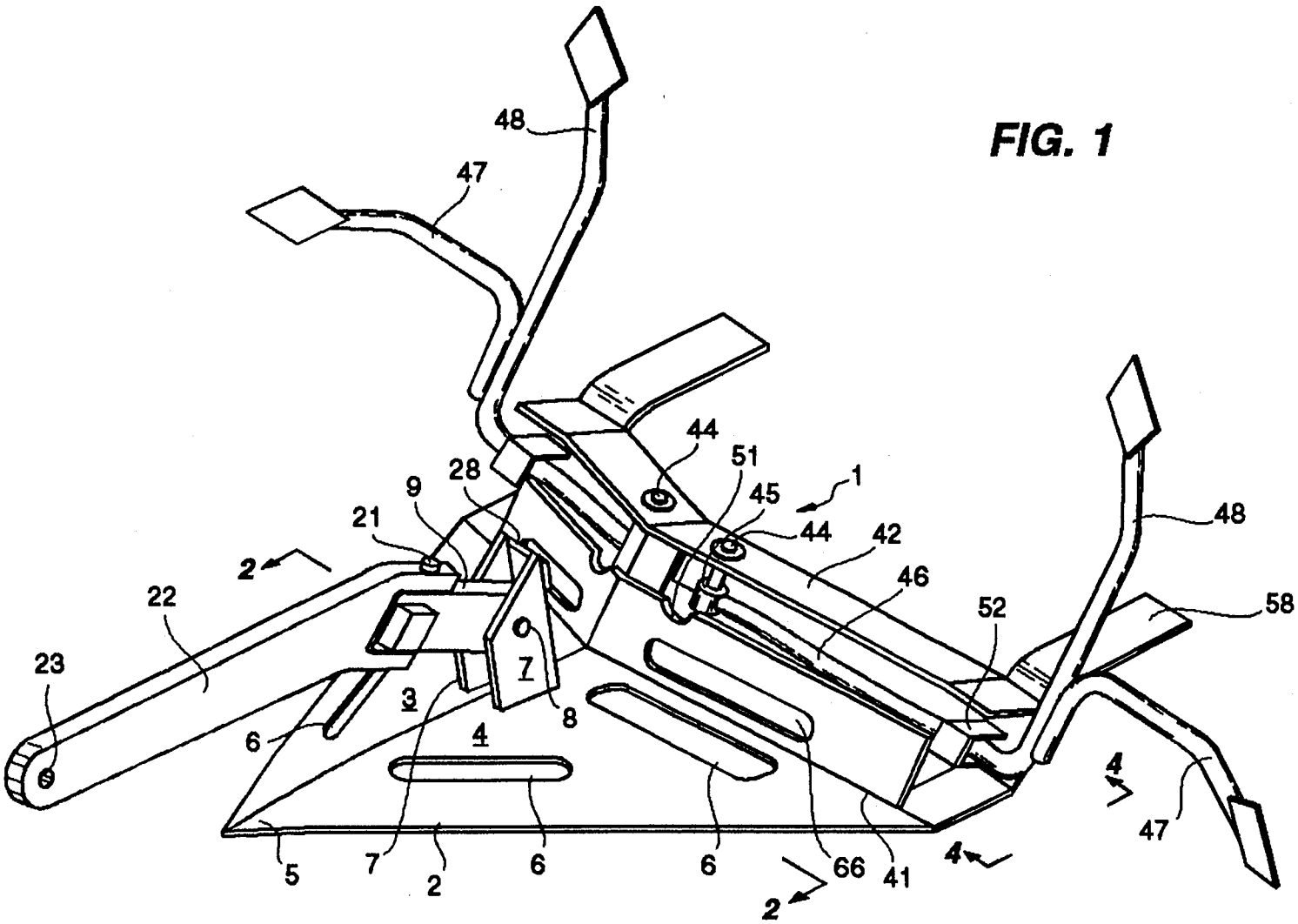
FIG. 1 is an isometric view of the anchor.

1. Anchor
2. Plough
3. Wing
4. Wing
5. Turn down point
6. Slots
7. Lugs
8. Pivot pin
9. Pivot body
21. Pivot pin
22. Shank
23. Hole
31. Upper surface line
32. Line
33. Line
41. Rear end
42. Box section
43. Reinforcing web
44. Pivot pins
45. Sleeves
46. Arms
47. Tine
48. Tine
51. Slots
52. Abutments
54. Dash line
56. Dash line
58. Plates
61. Top
62. Bottom
63. Base
66. Slots
67. Slots

DETAILED DESCRIPTION WITH RESPECT TO THE DRAWINGS

Figure 2:
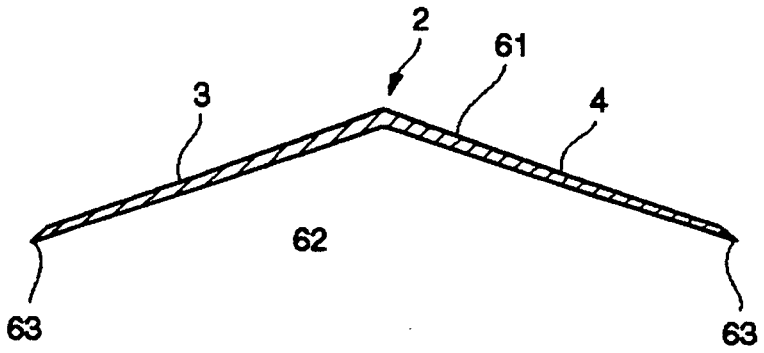
FIG. 2 is a cross-sectional view on line II—II in FIG. 1.
Figure 3:
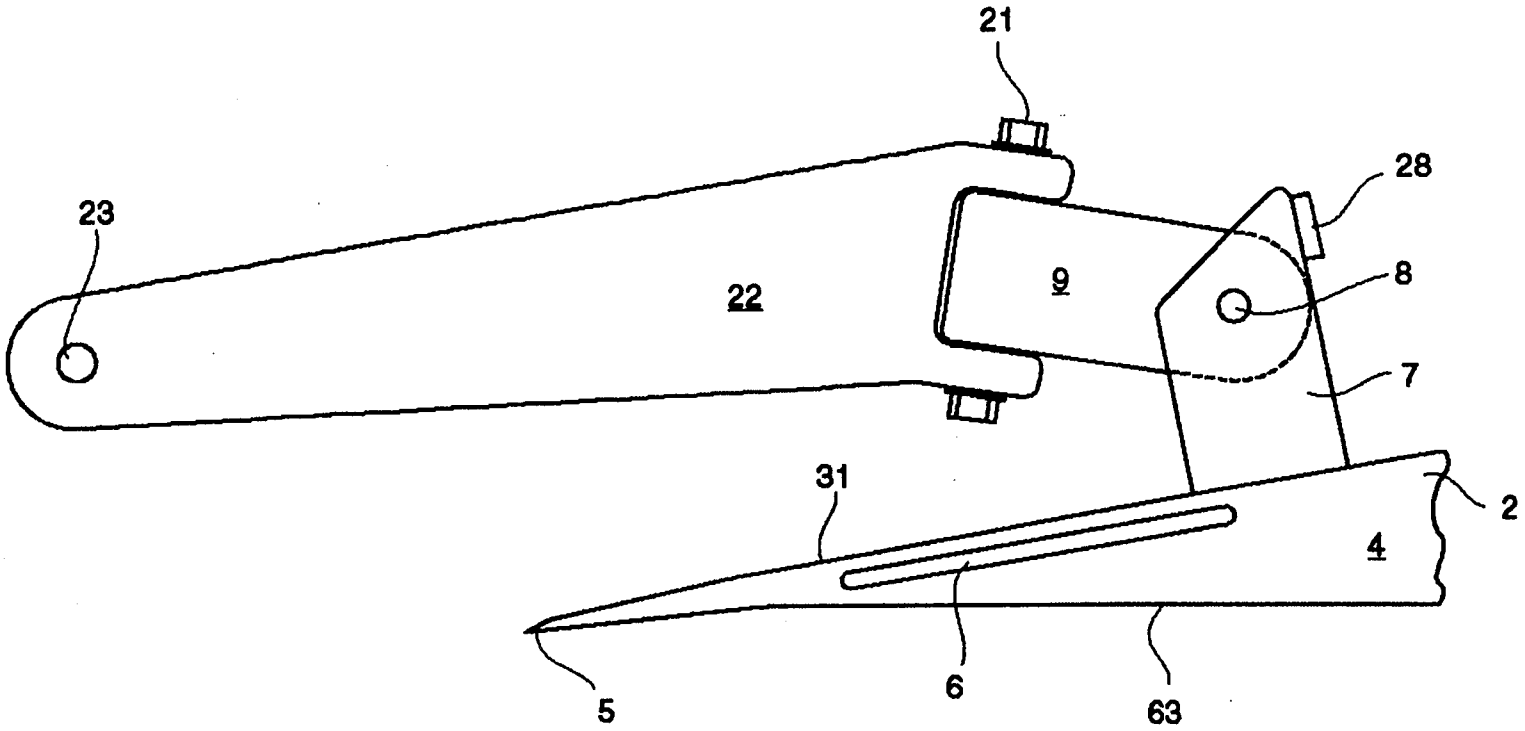
FIG. 3 is a side view of part of the anchor.
Figure 4:
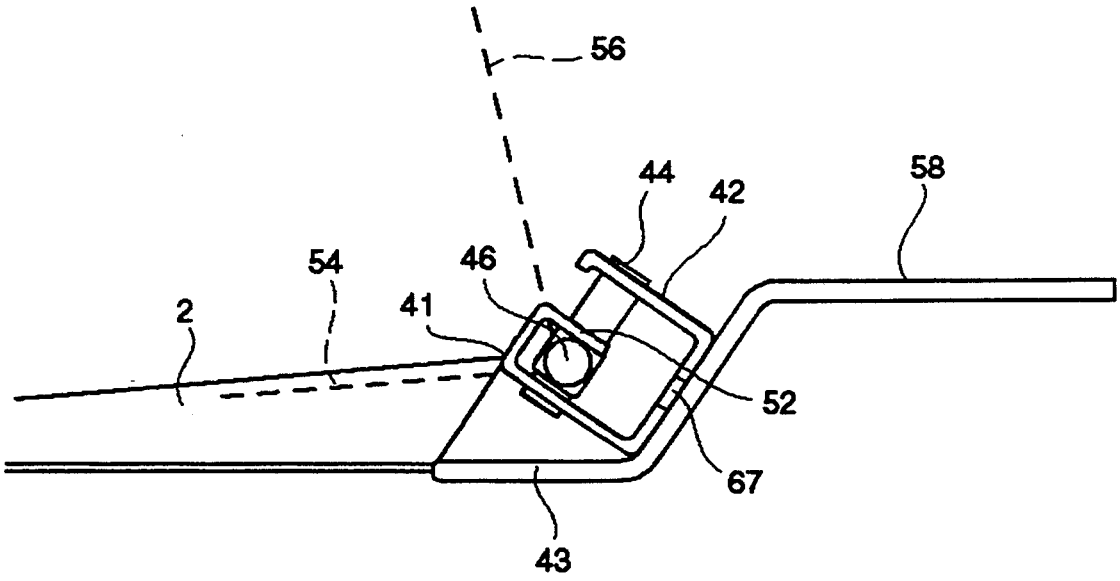
FIG. 4 is a view generally on line IV—IV in FIG. 1.

The anchor 1 shown in the drawings comprises a plough 2 which is made up of two generally triangular wings 3 and 4 which are V-shaped as shown in FIG. 1 and which, in cross-section, are V-shaped as shown in FIG. 2. Further, the wings are also V-shaped when seen in side elevation as shown in FIG. 3.

The wings 3 and 4 terminate at a turn down point 5 at one end and at a rear end at 41.

The plough 2 has slots 6 for a purpose to be explained hereafter.

Lugs 7 are mounted to the plough 2 and support a pivot pin 8.

Mounted on the pivot pin 8 is a pivot body 9 which in turn is mounted by a pivot pin 21 to an anchor shank 22 which has a hole 23 for connection of an anchor chain, rope or the like.

The lugs have an abutment 28 which limit pivoting of the pivot body 9 about pivot pin 8 and hence limit the pivoting of the shank 22.

Mounted to the rear end 41 of the plough 2 is a box section 42 which is joined to the plough 2 also by a reinforcing web 43.

The box section 42 supports pivot pins 44 on which are mounted sleeves 45. The pivot pins 44 may be fixed in position or removable.

Arms 46 extend from the sleeves 45 and carry tines 47 and 48.

The sleeves 45 can pivot on the pins 44 between positions in which the tines 47 and 48 are inboard of the plough or extend outboard of the plough as shown at the top of FIG. 1.

When the tines 47 and 48 are inboard, the arms 46 can locate in respective slots 51 in the box section and in this condition the arms 46 and tines 47 and 48 are stowed for storage.

For use in anchoring, the arms 46 will extend outwardly of the plough 2 as shown in FIG. 1 and in this condition the arms can locate below the abutments 52 carried by the box section 42 which will keep them in position.

The tines 47 and 48 both extend generally forwardly with respect to the anchor when deployed for use and the tines 47 are somewhat convergent and the tines 48 are somewhat divergent.

Further, the tines 47 are horizontally or somewhat downwardly directed as is indicated by dash line 54 while the tines 48 are somewhat upwardly directed as is indicated by the dash line 56.

Plates 58 are secured to the box section 42.

The box section 42 has slots 66 in its front wall and slots 67 in its rear wall.

The plough 2 can be considered to have a top 61 and a bottom 62.

The manner of use of the anchor 1 will now be described.

For storage, the arms 46 are folded inboard and in this condition the anchor may be readily stored without the tines 47 and 48 unduly interfering with any gear.

For use of the anchor in sand, mud or gravel the arms 46 are deployed as shown in FIG. 1 and the arms 46 are engaged underneath the abutments 52.

When so configured, the anchor will act substantially like a plough anchor and the plough 2 will readily dig into sand, mud or gravel.

The slots 6, 66 and 67 assist in rapid sinking of the anchor in that water can pass therethrough and will assist in movement of sand to beneath the anchor.

The tines 47 and 48 will have little effect in sand, mud or gravel but if rock is encountered, they will grip that rock. Similarly the tines 47 and 48 will also grip any coral that may be encountered.

To retrieve the anchor from the bottom of a body of water, it is only necessary that the boat or other water borne vehicle is driven over the top of the anchor until any anchor rope is more or less straight up and down. Thereupon the anchor rope can be hauled upon to break the plough 2 out of the sand, mud or gravel. In breaking out, substantial suction will be found tending to hold the anchor in place but the slots 6, 66 and 67 will assist in breaking that suction and will allow water to pass through the plough 2 and box section 42.

When anchoring in rock or coral, the arms 46 are deployed as previously stated in respect of sand, mud or gravel.

As a result of the times 47 and 48 engaging with rock or coral the anchor will tend to tip over so that the bottom 62 becomes uppermost and the top 61 becomes lowermost and in that condition the tines 47 and 48 will readily grip rock or coral both by penetration of the tines 47 and 48 and by the gripping of rock or coral between the tines 47 and 48.

To retrieve the anchor 1 from rock or coral, the anchor rope is again hauled upon with the boat or other water borne vehicle located substantially above the anchor and the anchor is lifted. The lifting should free the tines 47 which will be uppermost and, further, the anchor can pivot about the plates 58 so as to lift the tines 48 from the rock or coral.

Further, since the anchor is in a condition with the bottom 62 on top and the top 61 on the bottom, the arms 46 will probably not be captured by the abutments 52 and this should assist in disengaging the tines 47 and 48 from rock or coral.

The above described anchor has been found to provide good holding in sand, mud, gravel, rock and coral and has particularly been found to do little damage to the environment, particularly coral reefs where conventional anchors are known to cause substantial damage.

If desired, an anchor chain can be sheathed in plastics material to further protect coral and reef. Such sheathing will also protect a users hands and will protect paintwork and fittings.

The anchor may be made in any desired size to suit different sizes of boat.

Finally it is to be understood that various alterations, modifications and or additions may be incorporated into the various constructions and arrangements of parts without departing from the spirit and ambit of the invention.

The claims and drawings form part of the disclosure of this specification.

I claim:

1. An anchor comprising:

a plough portion which is generally V-shaped in plan to taper from a broad portion at one end to a holding entering point at the other end, and which is generally V-shaped in cross-section transverse to the length of the plough portion between the ends, a shank attached to the plough portion and to which an anchor cable, chainrope or rode may be affixed, and tines extending from adjacent the broad portion of the plough portion in a generally forward direction wherein there are a pair of such tines on each side of the plough and one of each said pair is upwardly directed and the other is downwardly directed.

2. An anchor as claimed in claim 1, wherein the tines are mounted laterally outboard of the plough portion.

3. An anchor as claimed in claim 2, wherein the tines are mounted to arms and wherein the arms are pivotally mounted so that the arms may swing from a laterally outwardly extended condition to an inboard position.

4. An anchor as claimed in claim 3, wherein abutment means is provided to maintain the arms in said laterally outwardly extended condition.

5. An anchor as claimed in claim 1, wherein the shank is mounted to the plough portion to pivot up and down about a generally horizontal axis through 40° or less.

6. An anchor as claimed in claim 1, wherein the plough has apertures to release suction in sand or mud during recovery of the anchor.

7. An anchor comprising:

a plough portion which is generally V-shaped in plan to taper from a broad portion at one end to a holding entering point at the other end, and which is generally V-shaped in cross-section transverse to the length of the plough portion between the ends, a shank attached to the plough portion and to which an anchor cable, chainrope or rode may be affixed, and tines extending from adjacent the broad portion of the plough portion in a generally forward direction wherein the shank is mounted to the plough portion to pivot from side to side about a generally vertical axis.

* * * * *